US005099744A

United States Patent [19]

Hurst et al.

[11] Patent Number: 5,099,744

[45] Date of Patent: Mar. 31, 1992

[54] BRAIDING MACHINE

[75] Inventors: Michael J. Hurst; John P. Harrington, both of Southampton, England

[73] Assignee: Karg Limited, Hampshire, England

[21] Appl. No.: 650,905

[22] Filed: Feb. 5, 1991

[30] Foreign Application Priority Data

Feb. 7, 1990 [GB] United Kingdom ..... 9002741

[51] Int. Cl.[5] ..... D04C 3/02

[52] U.S. Cl. ..... 87/45; 87/48

[58] Field of Search ..... 87/33, 44, 45, 48

[56] References Cited

U.S. PATENT DOCUMENTS

| | | | |
|---|---|---|---|
| 858,735 | 7/1907 | Lundgren | 87/45 |
| 1,409,298 | 3/1922 | Horn et al. | 87/45 |
| 1,808,463 | 6/1931 | Horn | 87/45 |

FOREIGN PATENT DOCUMENTS

| | | | |
|---|---|---|---|
| 22434 | of 1914 | United Kingdom | 87/45 |
| 109180 | 9/1917 | United Kingdom | 87/45 |

*Primary Examiner*—Joseph J. Hail, III

*Attorney, Agent, or Firm*—Notaro & Michalos

[57] ABSTRACT

A braiding machine comprises an annular rotor (27, 28) provided with a plurality of radially extending peripheral slots (29) between which are provided mechanisms (30) mounting first supply spools (31) on the rotor (27, 28), pivotable arm members (32) are mounted on the rotor (27, 28) for moving the strands from the spools (31) into and out of the slots (29), a plurality of carrier members (39) are mounted on the rotor for movement about the axis of the rotor (27, 28) and each carrier member (39) is provided with a second spool (44), drive (41, 42, 16) are provided for moving each carrier member (39) in the opposite direction of rotation to that of the rotor (27, 28) and at the same rotational speed, the drive (41, 42, 16) including bevel gears (42) mounted on the rotor (27, 28), a toothed rack (41) provided on each carrier member (39) in engagement with the bevel gears (42) and an annular driving gear (16) in engagement with the bevel gears (42), some of the bevel gears (42) being connected to a further gear (46) engaged with a gear (47) provided on a shaft (48) connected with a cam (35) for effecting pivotable movement of a respective pivotable arm member (32).

8 Claims, 4 Drawing Sheets

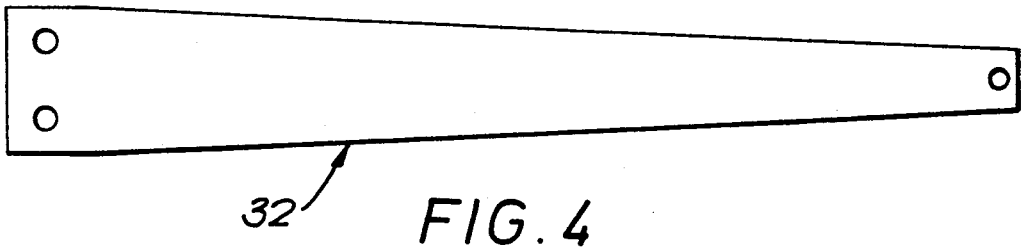
FIG. 4
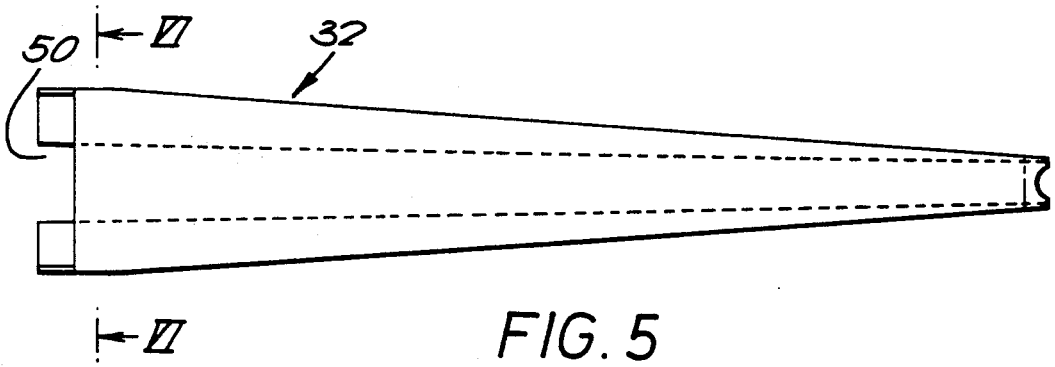
FIG. 5
FIG. 6
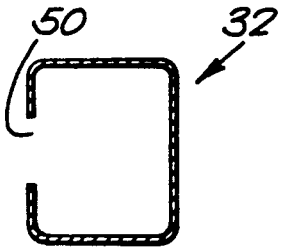
FIG. 7
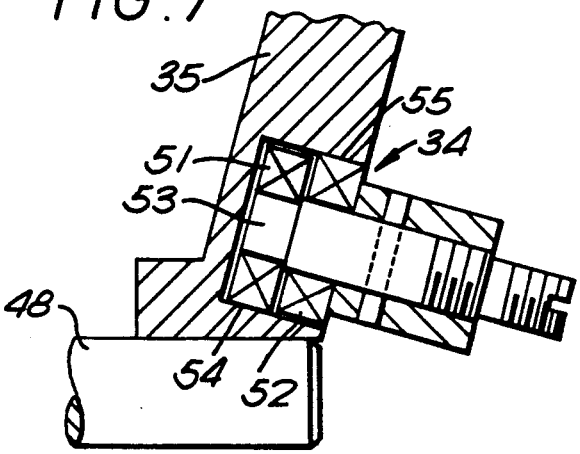

BRAIDING MACHINE

This invention relates to a braiding machine, for example a machine for entwining strands from supply spools or bobbins about an elongate member, such as a wire or cable.

According to the present invention there is provided a braising machine comprising an annular rotor provided with a plurality of radially extending peripheral slots, means located between each of said slots for mounting a first supply spool or bobbin on the rotor, pivotable arm members mounted on the rotor for use in moving the strands extending from the first supply spools or bobbins into and out of said slots, a plurality of circumferentially spaced apart carrier members mounted on said annular rotor for rotation about the axis of said annual rotor, each carrier member being provided with means for mountin a second supply spool or bobbin thereon, drive means for rotating each carrier member in the opposite direction of rotation to that of said rotor and at the same rotational speed, said drive means for each carrier member including bevel gears mounted on the rotor, a toothed rack provided on each carrier member in driving connection with the bevel gears and an annular driving gear in driving connection with the bevel gears, some of said bevel gears being connected to a further gear in driving connection with a gears provided on a shaft drivingly connected with a cam member for effecting pivotable movment of a respective one of said pivotable arm members.

Preferably the carrier members are mounted on rollers provided on said annular rotor. The annular rotor is preferably provide with two concentric annular arrays of rollers and each carrier member is provided with an arcuate slide member received between the two annular arrays of rollers.

An embodiment of the invention will now be described, by way of an example, with reference to the accompanying drawings, in which:

FIG. 4 is a plan view of an alternative form of a pivotable arm member;

FIG. 5 is a side elevation of the arm member shown in FIG. 4;

FIG. 6 is a cross-section taken along the line VI—VI shown in FIG. 5; and

FIG. 7 is a longitudinal section through an alternative form of cam follower.

Figure 1:
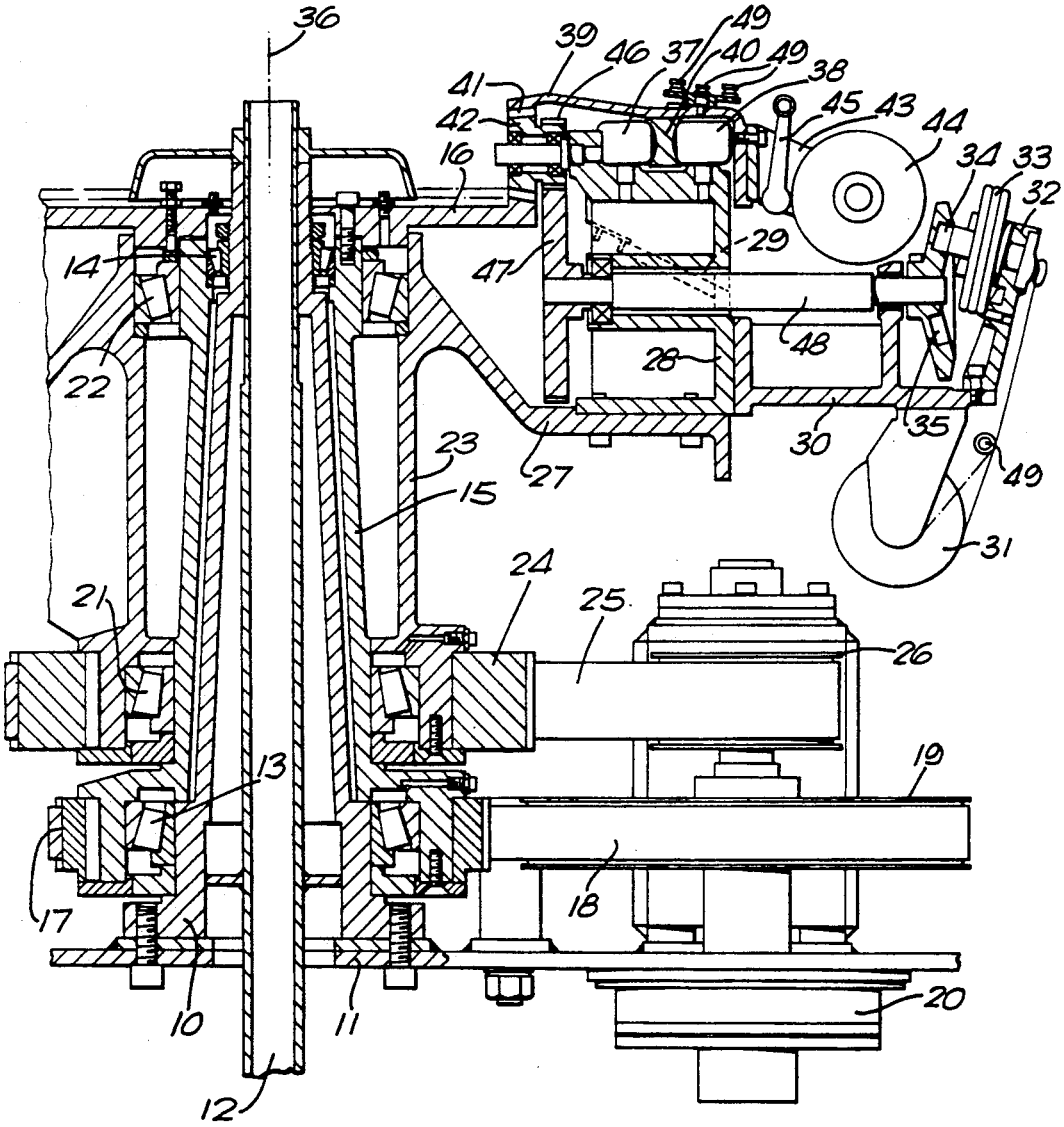
FIG. 1 is a partial logitudinal cross-section through a braiding machine embodying the present invention.
Figure 2:
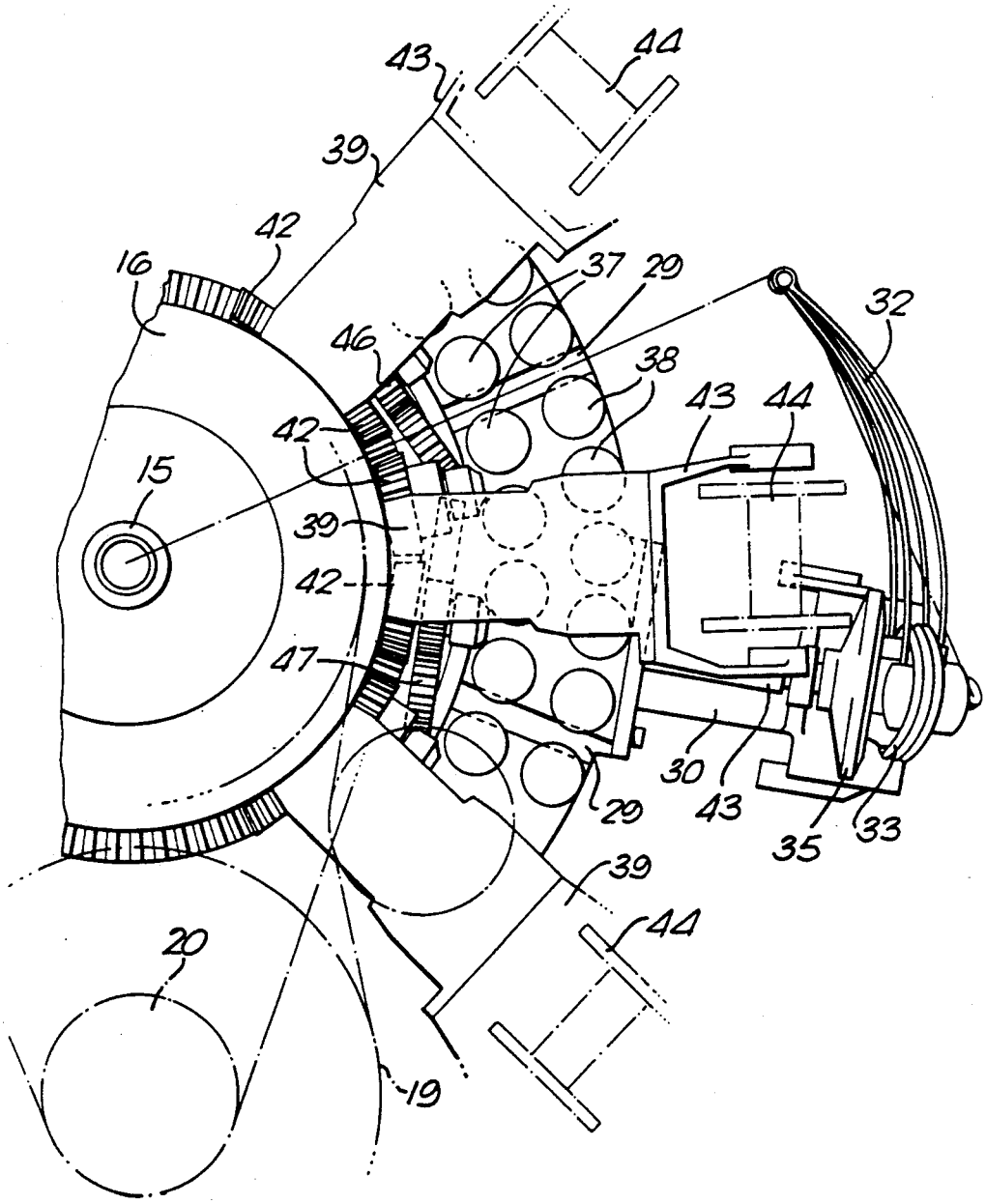
FIG. 2 is a partial plan view of the braiding machine.
Figure 3:
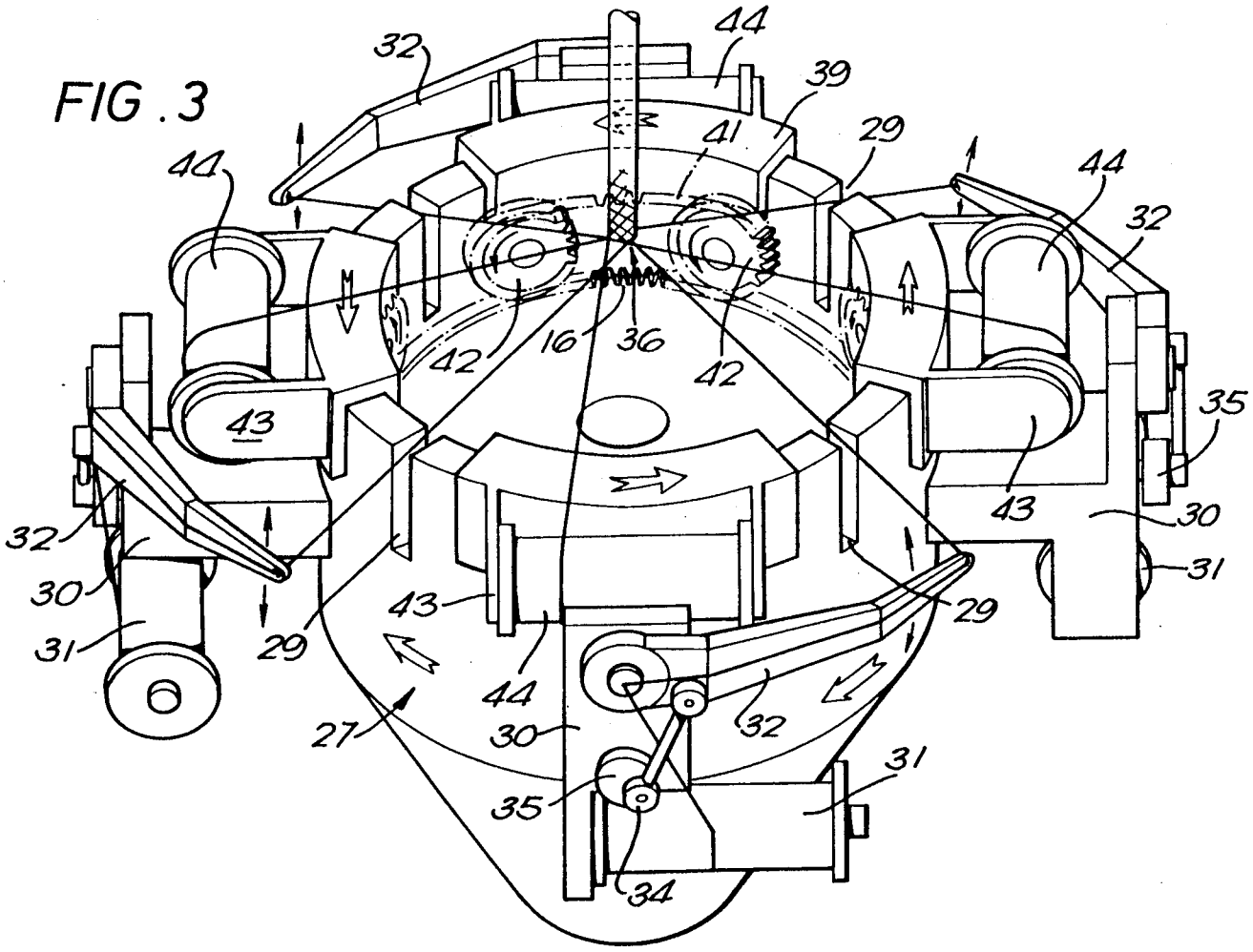
FIG. 3 is a diagrammatic perspective view of the braiding machine.

The braiding machine shown in FIGS. 1 to 3 of the drawings is provided with a vertically extending pillar 10 mounted on support structure 11. The pillar 10 is hollow and extending through the pillar 10 is a vertical tube 12 through which extends the elongate member, such as a wire or cable, on which the braiding is to be applied. The elongate member will be drawn from a take-off spool or reel (not shown) by a capstan (not shown) and the braided elongate material fed to a take-up spool or reel (not shown).

The pillar 10 is provided with bearings 13 and 14 on which is mounted a drive shaft 15 connected at its upper end to an annular driving gear 16. The drive shaft 15 is provided with a ger 17 enaged by a toothed drive belt 18 driven by a gear 19 driven by an electric drive motor 20.

Mounted on the drive shaft 15 are bearings 21 and 22 which rotatably support a second drive shaft 23 provided with a gear 24 engaged by a toothed drive belt 25 driven by a gear 26 driven by the electric driven motor 20. The driven shaft 23 forms part of an annular rotor 27 having at its periphery a channel-section annular member 28 which is provided with a plurality of circumferentially spaced apart radially extending peripheral slots 29 whose bottom ends are downwardly inclined towards the outer periphery of the annular member 28.

Located between each of the slots 29 and supported by members 30 are first supply spools or bobbins 31 which contain strands to be entwined about the elongate material. Mounted on each member 30 is a pivotable arm member 32 which is acted upon by a coil spring 33. Each arm member 32 is caused to pivot about its mounting against the force of the spring 33 by a cam follower 34 engaged with a respective cam 35. The strand from each spool or bobbin 31 engages with the outer end of a respective pivotable arm member 32 and extends to the braiding point 36. In operation of the braiding machine the strand from a spool or bobbin 31 in one position of the associated arm member 32 passes through a slot 29 and in another position of the associated arm member 32 is lifted clear oif the slot 29.

The annular member 28 of the rotor 27 is provided with two concentric annular arrays of rollers 37 and 38. Mounted on the rotor 27 by means of said rollers 37, 38 are a plurality of circumferentially spaced apart carrier memebers 39 each having an arcuate slide member 40 which is received between and engages both arrays of rollers 37, 38. Each carrier member 39 is provided with a toothed rack 41.

Rotatably mounted on the member 28 are a plurality of bevel gears 42 which are drivingly engaged with the annular driving gear 16.

The toothed rack 41 of each carrier member 39 is engaged with a least one of the bevel bears 42 at any one time during operation of the machine.

Each carrier member 39 is provided with a member 43 which rotatably supports a second supply spool or bobbin 44 thereon. Each carrier member 39 is provided with a pivotable tensioning arm 45 which serves to tension the strand extending from the supply spool or bobbin 44 to the braiding point 36.

Alternate bevel gears 42 are connected to a spur gear 46 which meshes with a gear 47 provided on a shaft 48 on which a said cam 35 is mounted.

During operation of the braiding machine the drive shaft 15 and the annular driving gear 16 are driven at a higher rotational speed than the drive shaft 23 by the motor 20. Due to the gear ratio between the annular driving gear 16 and the bevel gears 42 the carrier members 39 are driven at the same lower rotational speed as the drive shaft 23 and the rotor 27 but in the opposite direction of rotation. As the carrier members 39 move around the rotor 27 they pass under the strands from the supply spools or bobbins 31 when the strands are lifted clear of the respective slots 29 by the respective arm members 32. Thus, the strands from the supply spools or bobbins 31 are entwined with the strands from the supply spools or bobbins 44 at the braiding point 36 as the elongate material is drawn up the tube 12.

At no time are any of the strands from the supply spools or bobbins 31 and 44 in sliding contact with any part of the machine. They are only in contact with guide rollers or pulleys 49 which are provided on various parts of the machine. Thus the strands are not subject to sliding friction and the machine can thus be operated at high rotational speed without the strands being subjected to frictional forces which can result in breakange of a strand and heating of a strand.

In FIG. 3 the various components of the braiding machine are illustrated diagrammatically and in less detail than in FIGS. 1 and 2 but this Figure serves to illustrates the principles of the braiding machine.

The rollers 37, 38, arcuate slilde member 40 and cams 35 may be coated with a dry lubricant material, such as a PTFE based material. Other parts of the machine may also be coated with such lubricant.

The wire arm member 32 may have the form shown in FIGS. 4 to 6 of the drawings and which comprise sheet metal, preferably sheet aluminium, which is bent into a substantially rectangular section leaving a slot 50 on an outer side. The arm member tapers in cross-section from its mounting end towards its outer end. The slot 50 enables braiding material from each spool 31 to be easily passed along the interior of the arm member during the intial wiring-up of the braiding machine.

The cam follower 34 may have the form shown in FIG. 7 of the drawings. In this arrangement the cam follower 34 comprises two rollers 51 and 52 mounted on a mounting pin 53. The roller 51 is mounted eccentric to the rotational axis of the roller 52 so that the periphery of roller 51 contacts the inner face 54 of the cam 35 and the periphery of roller 52 contacts the outer face 55 of the cam 35. Such an arrangement avoids having to provide resilient means for maintaining the follower 34 in contact with the cam surface and it minimises impact loading and slippage which can occur where only a single roller is provided as a cam follower.

We claim:

1. A braiding machine comprising an annular rotor (27, 28) provided with a plurality of radially extending peripheral slots (29), means (30) located between each of said slots (29) for mounting a first supply spool or bobbin (31) on the rotor (27, 28), pivotable arm members (32) mounted on the rotor (27, 28) for use in moving the strands extending from the first supply spools or bobbins (31) into and out of said slots (29), a plurality of circumferentially spaced apart carrier members (39) mounted on said annular rotor (27, 28) for rotation about the axis of said annual rotor (27, 28), each carrier member (39) being provided with means (43) for mounting a second supply spool or bobbin (44) thereon, drive means (41, 42, 16) for rotating each carrier member (39) and the rotor (27, 28) in opposite directions and at the same rotational speed, said drive means (41, 42, 16) for each carrier member (39) including bevel gears (42) mounted on the rotor (27, 28) a toothed rack (41) provided on each carrier member (39) in driving connection with the bevel gears (42) and an annular driving gear (16) in driving connection with the bevel gears (42), some of said bevel gears (42) being connected to a further gear (46) in driving connection with a gear (47) provided on a shaft (48) drivingly connected with a cam member (35) for effecting pivotable movement of a respective one of said pivotable arm members (32).

2. A braiding machine as claimed in claim 1, in which the carrier members (39) are mounted on rollers (37, 38) provided on said annular rotor (27, 28).

3. A braiding machine as claimed in claim 2, in which the annular rotor (27, 28) is provided with two concentric annular arrays of rollers (37, 38) and each carrier member (39) is provided with an arcuate slide member (40) received between the two annular arrays of rollers (37, 38).

4. A braiding machine as cliamed in claim 3 including a vertically extending pillar (10) mounted on support structure (11), a vertical tube (12) extending through the pillar (10) and through which an elongate member on which braiding is to be applied is drawn, a drive shaft (15) rotatably mounted on said pillar (10) and connected to annular driving gear (16) forming part of said drive means (41, 42, 16) for rotating the carrier members (39), a second drive shaft (23) rotatably mounted on the drive shaft (15) and forming part of the annular rotor (27, 28) drive means (17, 18, 19) for said drive shaft (15) and drive means (24, 25, 26) for said second drive shaft (23), each drive means (17, 18, 19; 24, 25, 26) being driven by a motor (20), said drive shaft (15) in use of the braiding machine being driven at a higher rotational speed than the second driven shaft (23).

5. A braiding machine as claimed in claim 4, in which the annular driving gear (16) and the bevel gears (42) are driven at the same speed as the second drive shaft (23) but in the opposite direction of rotation.

6. A braiding machine as claimed in claim 5 including guide rollers or pulleys (49) for guiding strands from the first supply spools or bobbins (31, 44) to a braiding point (36).

7. A braiding machine as claimed in claim 6 in which the pivotable arm members (32) are each formed of sheet metal bent into a substantially rectangular cross-section which tapers from the mounting end towards the outer end, the outer side of each arm member (32) being provided with a slot (50).

8. A braiding machie as claimed in claim 6 in which each cam member (35) is engaged by a cam follower (34) which comprises two rollers (51, 52), one roller (51) being mounted eccentric to the rotational axis of the other roller (52).

* * * * *